US006877638B2

(12) United States Patent
Chan et al.

(10) Patent No.: US 6,877,638 B2
(45) Date of Patent: Apr. 12, 2005

(54) UNIFORM DISPENSING, MULTI-CHAMBERED TUBE COMPRISING A FLOW REGULATING ELEMENT

(75) Inventors: John Geoffrey Chan, Loveland, OH (US); Li Li, Ganluyuan (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/342,647

(22) Filed: Jan. 15, 2003

(65) Prior Publication Data

US 2003/0106905 A1 Jun. 12, 2003

Related U.S. Application Data

(63) Continuation of application No. PCT/US02/21792, filed on Jul. 11, 2002.
(60) Provisional application No. 60/304,671, filed on Jul. 11, 2001.

(51) Int. Cl.[7] ..... B67D 5/060
(52) U.S. Cl. ..... 222/145.3; 222/94
(58) Field of Search ..... 222/145.1, 145.3, 222/94

(56) References Cited

U.S. PATENT DOCUMENTS

| | | | | |
|---|---|---|---|---|
| 1,894,115 A | | 1/1933 | Murphy | |
| 2,905,364 A | * | 9/1959 | Marraffino | 222/94 |
| 3,197,071 A | * | 7/1965 | Kuster | 222/94 |
| 3,227,319 A | * | 1/1966 | Rosier | 222/94 |
| 3,788,520 A | | 1/1974 | Dukess | |
| 4,585,149 A | | 4/1986 | Zulauf | |
| 4,893,729 A | | 1/1990 | Iggulden et al. | |
| 5,102,013 A | * | 4/1992 | Schneider et al. | 222/94 |
| 5,328,056 A | * | 7/1994 | Schneider et al. | 222/94 |
| 5,921,440 A | | 7/1999 | Maines | |
| 5,927,550 A | | 7/1999 | Mack et al. | |
| 5,941,420 A | * | 8/1999 | Connan | 222/94 |
| 5,954,234 A | | 9/1999 | Connan et al. | |
| 6,223,943 B1 | | 5/2001 | Richmond et al. | |
| 6,578,739 B2 | * | 6/2003 | Scheifele | 222/94 |

FOREIGN PATENT DOCUMENTS

| | | |
|---|---|---|
| DE | 820268 C | 11/1951 |
| FR | 2643615 A | 8/1990 |
| GB | 219540 A | 7/1924 |

(Continued)

*Primary Examiner*—Michael Mar
*Assistant Examiner*—M A Cartagena
(74) *Attorney, Agent, or Firm*—Angela K. Haughey; Emelyn L. Hiland

(57) ABSTRACT

Disclosed is a multi-chambered tube for containing and dispensing a contents, comprising: (a) a body divided by at least one divider wall into at least two chambers, each chamber housing a portion of the contents, the body being sealed at one end by a crimp seal and one end of the divider wall being sealed within the crimp seal; (b) a shoulder attached to the body; (c) a nozzle attached to the shoulder and provided with an orifice through which the contents are dispensed; (d) a flow regulating element located in the shoulder of the tube and being comprised of as many sections as there are body chambers, and each section being provided with at least one aperture; (e) at least one partition separating the sections of the flow regulating element from each other and dividing the nozzle into as many nozzle chambers as there are body chambers, each nozzle chamber being in communication with a body chamber via the aperture(s) in the corresponding section of the flow regulating element. Also disclosed is such a multi-chambered tube in which the first and second chambers are concentric, and the tube is provided with a first flow regulating element located in the shoulder of the first chamber wherein the first portion of the contents passes through the first flow regulating element during dispensing; and a second flow regulating element located in the shoulder of the second chamber wherein the second portion of the contents passes through the second flow regulating element during dispensing.

3 Claims, 7 Drawing Sheets

FOREIGN PATENT DOCUMENTS

| | | |
|---|---|---|
| GB | 2017292 | 4/1970 |
| WO | WO 97/46462 A1 | 12/1997 |
| WO | WO 97/46463 A1 | 12/1997 |
| WO | WO 00/13980 A1 | 3/2000 |

* cited by examiner

UNIFORM DISPENSING, MULTI-CHAMBERED TUBE COMPRISING A FLOW REGULATING ELEMENT

CROSS REFERENCE RELATED TO APPLICATIONS

This is a continuation of International Application PCT/US02/21792 with an international filing date of Jul. 11, 2002, which claims benefit of Provisional Application Ser. No. 60/304,671 filed Jul. 11, 2001.

FIELD

The present invention relates to a multi-chambered tube comprising a flow regulating element for providing uniform dispensing of different components contained in each of the chambers of the tube, and is particularly useful for dispensing multi-phased dentifrice compositions.

BACKGROUND

Multi-chambered tubes for the simultaneous delivery of different substances when the tube is squeezed have previously been known. Concentric type tubes, in which chambers of generally circular cross section and of approximately equal volume are provided one within the other, as well as side by side type tubes, in which the chambers are generally adjacent to each other, have been proposed. In either case, achieving a simultaneous dispensing of each component from the tubular container that is uniform, regardless of where and how the container is squeezed, remains problematic. Another continuing problem is providing an attractive presentation of a dispensed multi-component composition contained in such a tube.

The amount of material dispensed from each chamber of a multi-chambered tube is dependent upon the decrease in volume of the chamber occasioned by the deformation of the walls of the chamber. This deformation, and thus the amount of material dispensed, depends upon several factors including the relative viscosities of the substances to be dispensed, the size and shape of the orifice(s) through which the substances are dispensed, the pressure applied to the tube, and the configuration of the tube and chambers. Concentric chambered tubes are generally believed to be less desirable as compared to side by side chambered tubes due to the increased skin friction seen by the composition in the outer chamber of a concentric tube that results from increased contact with the outer wall of the inner chamber.

U.S. Pat. No. 5,927,550, "Dual Chamber Tubular Container," issued to Mack et al. on Jul. 27, 1999 discloses a side by side tubular container having a dividing wall that is attached longitudinally to the tubular chamber sidewalls. The plane of the divider wall of the dispensing exit is offset from the plane of the crimp seal at the bottom of the tube preferably by about 90°. Other previously described tubular containers include those in which the crimp seal and the exit divider wall are in the same plane, e.g., U.S. Pat. Nos. 1,894,115 and 3,788,520; and German patent no. 2017292.

However, the tubular container described in the above-mentioned Mack et al. US patent is believed to be difficult to manufacture in terms of attaching the dividing wall to the tubular chamber sidewalls, and further in terms of connecting the dividing wall of the tube to the injected molded dividing wall of the tube shoulder. Thus, this tube is not believed to be easy or cost-effective to manufacture.

U.S. Pat. No. 5,954,234, "Uniform Dispensing Multi-chamber Tubular Containers," WO 97/46462, "Codispensing of Physically Segregated Dentifrices at Consistent Ratios," and WO 97/46463, "Uniform Dispensing Multi-chamber Tubular Containers," each describe a multichamber container in which the outer walls and inner divider walls have specified physical characteristics. The inner partition wall of this tube shifts laterally to respond to compressive displacement of the outer walls of the tube during squeezing. This partition wall is therefore made as thin and flexible as possible.

It is believed that uniformity of dispensing from this tube is less than ideal because the inner divider wall is thin and soft, thus making it difficult to build required pressure in the chambers to maintain even dispensing of a product, especially if the component compositions of the product are of greatly different relative rheologies and viscosities. Further, this tube has no device for flow regulation, making it difficult to maintain an even volume change across the chambers upon dispensing.

Based on the foregoing, there is a continued need for a multi-chambered dispensing tube that can consistently deliver the same amount, shape, and size of the component compositions contained in each chamber at the same dispensing rate, regardless of how the tube is squeezed. There is also a need for such a tube to be cost effective and easy to manufacture. None of the existing art provides all of the advantages and benefits of the present invention.

SUMMARY

The present invention is directed to a multi-chambered tube for containing and dispensing a contents, comprising: (a) a body divided by at least one divider wall into at least two chambers, each chamber housing a portion of the contents, the body being sealed at one end by a crimp seal and one end of the divider wall being sealed within the crimp seal; (b) a shoulder attached to the body; (c) a nozzle attached to the shoulder and provided with an orifice through which the contents are dispensed; (d) a flow regulating element located in the shoulder of the tube and being comprised of as many sections as there are body chambers, and each section being provided with at least one aperture; (e) at least one partition separating the sections of the flow regulating element from each other and dividing the nozzle into as many nozzle chambers as there are body chambers, each nozzle chamber being in communication with a body chamber via the aperture(s) in the corresponding section of the flow regulating element.

The present invention is further directed to such a multi-chambered tube in which the first and second chambers are concentric, and the tube is provided with a first flow regulating element located in the shoulder of the first chamber wherein the first portion of the contents passes through the first flow regulating element during dispensing; and a second flow regulating element located in the shoulder of the second chamber wherein the second portion of the contents passes through the second flow regulating element during dispensing.

These and other features, aspects, and advantages of the invention will become evident to those skilled in the art from a reading of the present disclosure.

BRIEF DESCRIPTION OF THE DRAWINGS

While the specification concludes with claims particularly pointing out and distinctly claiming the invention, it is believed that the present invention will be better understood from the following description of preferred embodiments taken in conjunction with the accompanying drawings, in which like reference numerals identify identical elements and wherein:

DETAILED DESCRIPTION

Although the following detailed description is given primarily in the context of a tube for containing a dentifrice product, it will be understood that the tube may be useful for containing and dispensing other products where it is desirable to contain multi-component or multi-phased compositions in separate chambers of the tube, mixing of the phases occurring only at the time of dispensing, for example, food products, hair care products, cosmetic products, chemical products and the like. In addition, the use of the term "dentifrice" herein should be understood to non-limitingly include oral care compositions such as toothpastes, gels, and combinations of such pastes and gels.

In addition, while the description herein is mainly given in the context of a body having two chambers, it is understood that the body and nozzle of the tube of the present invention may be divided into multiple chambers, with the flow regulating element correspondingly having as many sections as there are chambers and each body chamber housing a component portion of a composition. Such embodiments are within the scope of the present invention.

The tube of the present invention is desirably provided with a cap to protect the contents from exposure to the atmosphere when the tube is not in use. Any type of cap or lid that is resealably fittable to the tube nozzle may be used with the tube of the present invention, for example, a standard screw-on type cap. The cap may further be provided with a flip-open top for more convenient consumer use. For ease of illustration, the cap is not shown in the accompanying Figures.

Figure 1:
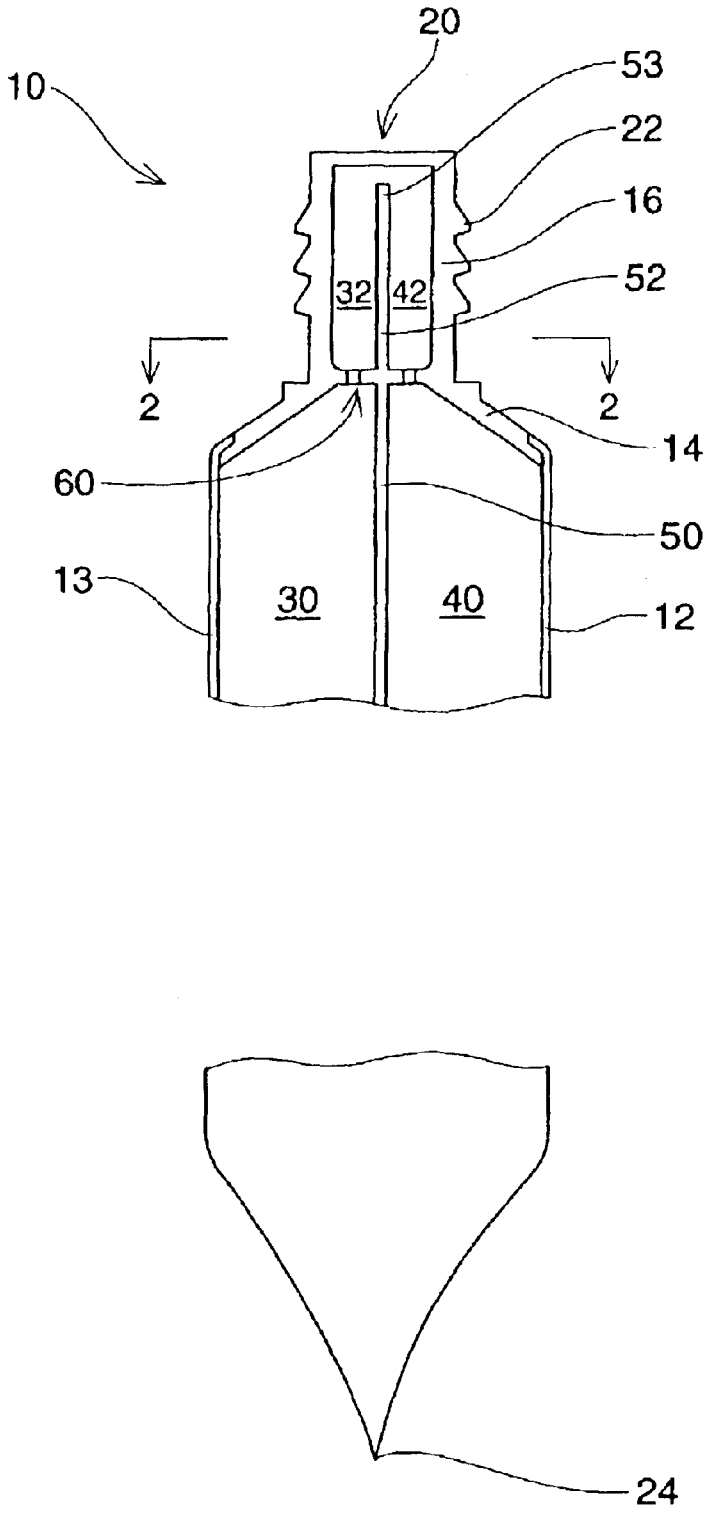
FIG. 1 shows a partial sectional view of a preferred embodiment of the tube of the present invention.

Referring to FIG. 1, a partial cross sectional view of a preferred embodiment of the tube of the present invention is shown. The tube 10 is generally comprised of a tube body 12, a shoulder 14, and a nozzle 16. The nozzle 16 is provided with an orifice 20 through which the product is dispensed when the tube body 12 is squeezed by the user. The nozzle 16 may be provided with threads 22 in order to facilitate the fitting of a cap (not shown) to the nozzle 16.

The tube body 12 may be comprised of any materials known to those of skill in the art that provide adequate storage of the dentifrice or other product contained in the tube. The materials comprising the body 12 should have no reaction with the components that comprise the contents, such that the contents could be rendered unsafe or otherwise unsuitable for consumer use. They should, of course, also be durable enough to withstand normal consumer use without leakage, tearing or breakage, etc.

For containing a dentifrice product, non-limiting examples of suitable materials from which the tube body 12 may be comprised include polyethylenes, such as low density polyethylene ("LDPE"), linear low density polyethylene ("LLDPE"), and high density polyethylene ("HDPE"), medial density polyethylene ("MDPE"), ethylene acrylic acid ("EAA"), foils, such as aluminum foil, or any of the above materials in any combination, for example, formed as a laminate structure.

The shoulder 14 is attached to the tube body 12 in continuous bonded or sealed contact 13 such that the contents of the tube are prevented from leaking out at this juncture. The nozzle 16 and the shoulder 14 are preferably continuously formed from a unitary piece of material (e.g., by injection molding) as shown in the Figures; alternatively, they may be comprised of separate pieces fused or otherwise securely attached to each other by any means known to those of skill in the art. In addition, the nozzle 16 and the shoulder 14 preferably have the same material composition, but alternatively may be comprised of different material compositions. Non-limiting examples of suitable materials from which the shoulder 14 and the nozzle 16 may be comprised include the polyethylenes described above.

Referring to the preferred embodiment shown in FIG. 1, the body 12 is divided into two side by side chambers by the divider wall 50: a first chamber 30 housing a first portion of the contents and a second chamber 40 housing a second portion of the contents. The body 12 is sealed at one end by a crimp seal 24, i.e., at the end opposite from the dispensing orifice 20. One end of the divider wall 50 is sealed within the crimp seal 24. The divider wall 50 extends from the crimp seal 24 through the interior of the body 12. The other end of the divider wall 50 is sealed to the interior surface of the flow restricting element 60. The divider wall 50 is sealed along its longitudinal edges to the interior surfaces of the body 12 and the shoulder 14.

Accordingly, different portions or components of a composition can be housed in each of the chambers 30 and 40 and kept separate until the time of dispensing. Each component will have different viscosity and different rheology characteristics; hence, the source of the difficulties in uniform dispensing.

The tube 10 of the present invention is provided with a flow regulating element 60 that regulates both the pressure and the flow of the component compositions inside the chambers 30 and 40 in order to ensure uniform dispensing. The flow regulating element 60 is located in the shoulder 14, i.e., between the body 12 and the nozzle 16. In the embodiment shown in FIG. 1, the flow regulating element is located at the base of the nozzle 16. The precise location of this element 60 may vary, as described in detail below. The flow regulating element 60 generally extends all the way to the circumference of the base of the nozzle or the shoulder, depending on its exact location within the tube, and is fitted securely to the inside of the tube. Preferably, the flow regulating element is molded as a part of the shoulder/nozzle piece.

Figure 2:
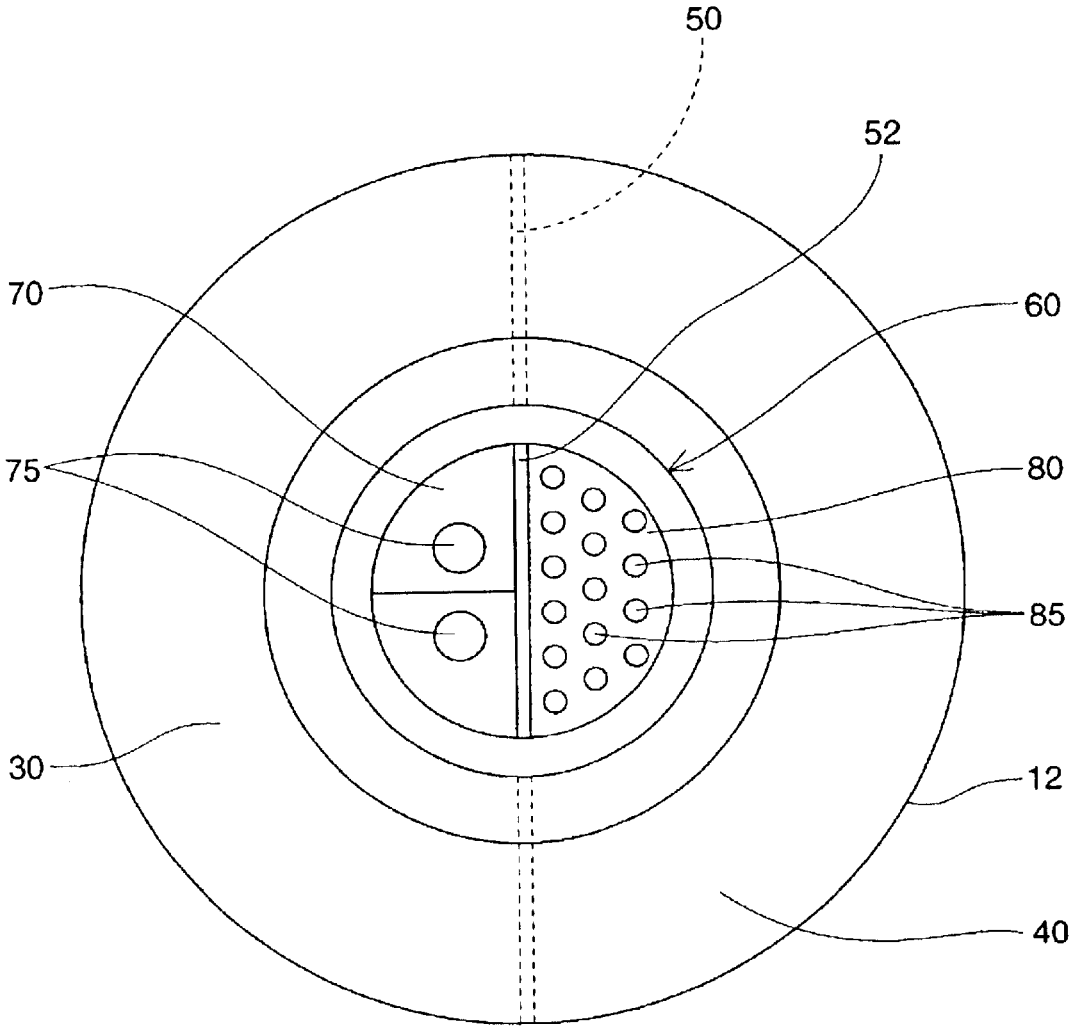
FIG. 2 shows a top sectional view taken along line 2—2 in FIG. 1.

As shown in FIG. 2, the flow regulating element 60 is generally in the form of a screen that is separated into sections by at least one partition 52. Preferably, the flow regulating element 60 is comprised of at least a first section 70 and a second section 80. The flow regulating element 60 will have as many sections as the tube has chambers. For example, in the preferred embodiment shown in FIGS. 1 and 2, the tube 10 has two chambers 30 and 40; correspondingly, the flow regulating device 60 has two sections 70 and 80.

The partition 52 of the flow regulating element 60 extends through the interior of the nozzle 16, dividing the nozzle into as many nozzle chambers as there are body chambers, e.g., first nozzle chamber 32 and second nozzle chamber 42. In the embodiment shown in FIG. 1, the partition 52 terminates at a location below the orifice 20 in the nozzle 16. In another preferred embodiment, the partition 52 extends past the orifice 20; then, when a cap is placed on the nozzle, the partition terminates at a location that is below the cap orifice.

The partition 52 and the sections 70 and 80 of the flow regulating element 60 may be formed from the same (e.g., HDPE) or from different materials. In the preferred embodiment shown in, e.g., FIGS. 1 and 2, the partition 52 is aligned with the divider wall 50 and is preferably continuously formed from a unitary piece of material with the shoulder 14 and the nozzle 16 (e.g., by injection molding).

Each section 70 and 80 of the flow regulating element 60 is provided with at least one aperture 75, 85. For example, as shown in FIG. 2, the first section 70 is provided with at least one first section aperture 75. The second section 80 is provided with at least one second section aperture 85. The number of apertures in each section of the flow regulating element 60, as well as the shape and dimension of each individual aperture, is determined by matching the viscosity and rheology characteristics of each of the components contained in each of the chambers of the tube. For example, for the component with the lesser relative viscosity and/or rheology, smaller-sized apertures and/or a smaller number of apertures may be chosen. For another component with a relatively greater viscosity and/or shear force, etc., larger apertures and/or a greater number of apertures may be chosen. Thus, the contents housed in each chamber of the tube are dispensed simultaneously and at a uniform dispensing rate.

Each nozzle chamber in is communication with a body chamber via the aperture(s) in the corresponding section of the flow regulating element. For example, as shown in FIG. 1, the first nozzle chamber 32 is in communication with the first body chamber 30 via the first section aperture(s) 75, and the second nozzle chamber 42 is in communication with the second body chamber 40 via the second section aperture(s) 85. Thus, when the tube is squeezed, as the portion of the contents contained in each chamber of the tube passes through its corresponding section of the flow regulating element 60, and its flow speed is balanced as it fills up each nozzle chamber 32, 42, see FIG. 1. As noted previously, the uppermost end 53 of the partition 52 preferably does not extend all the way to the top of the nozzle 16, as shown in FIG. 1. Instead, the uppermost end 53 of the partition 52 is preferably located at a distance of about 1 to 3 mm below the nozzle opening orifice. In the preferred embodiments herein, the uppermost end of the partition can extend from about half the distance between the flow regulating element 60 and the top of the nozzle 20, up to a distance of about 1 mm extending beyond the top of the nozzle.

This clearance allows the component streams, e.g., the first portion of the contents housed in chamber 30 and the second portion of the contents housed in chamber 40, to contact one another and merge after clearing the uppermost end 53 of the partition 52 (or the cap), but before actually exiting the tube via the orifice. This is important for ensuring uniform dispensing appearance of a dual phased product from the tube. It prevents the first and second portion component streams from exiting the tube in the form of disconnected or segregated strands. In addition, the component stream having a higher flow speed will tend to pull the component stream having a lower flower speed along with it as it exits the tube.

Figure 16:
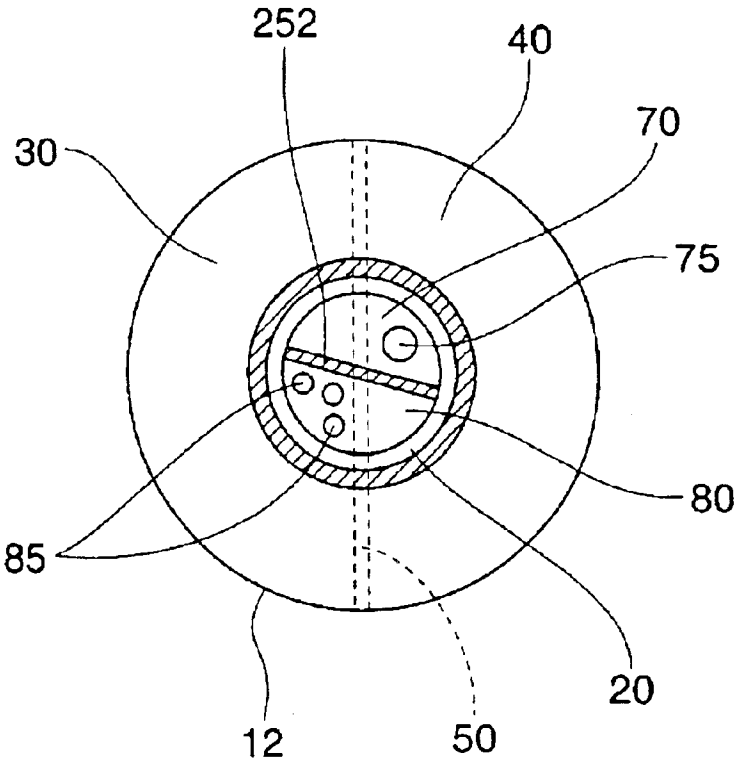
FIG. 16 shows a top sectional view taken along line 16—16 in FIG. 15.
Figure 15:
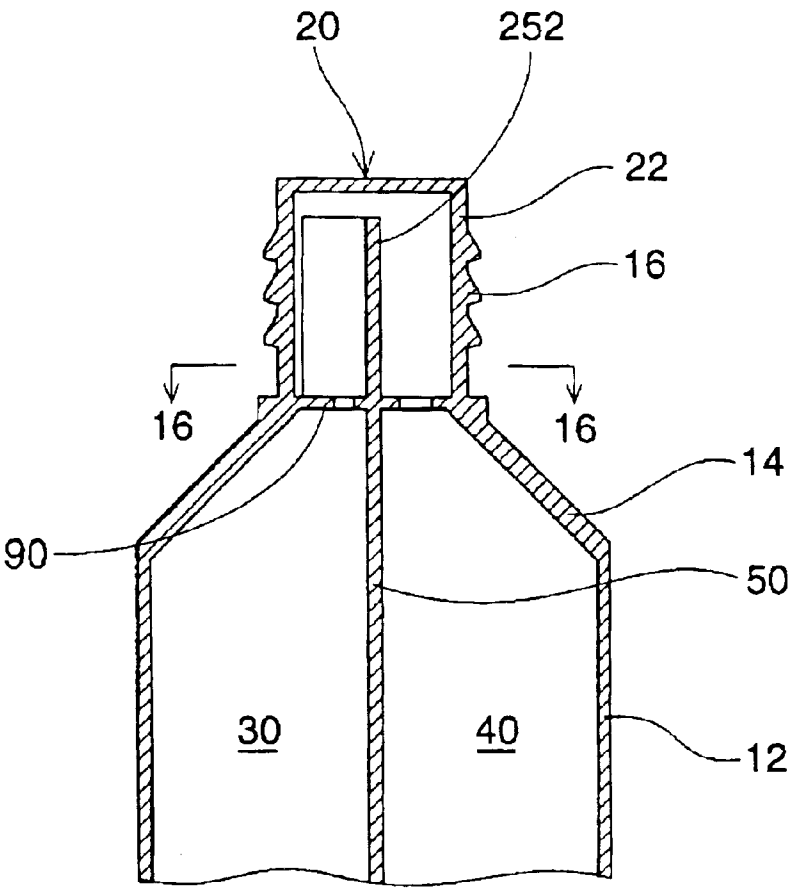
FIG. 15 shows a partial sectional view of yet another preferred embodiment of the tube of the present invention.

Referring to FIGS. 15 and 16, there is shown another preferred embodiment of the present invention. In this embodiment, the partition 252 of the flow regulating element 90 is offset with reference to the divider wall 50. Preferably this offset is from about 5 degrees to about 90 degrees with respect to the divider wall 50. An offset of about 30 degrees is more preferred. This offset may be used to provide effective visual impact of the dispensing of a dual phased product from the tube. It prevents the first portion component stream from exiting the tube opening in a position above the second portion component stream, and also from exiting the tube opening in a reversed position during dispensing.

As in the previously described embodiments, each section 70 and 80 of the flow regulating element 60 is provided with at least one first section aperture 75 and at least one second section aperture 85. For example, as shown in FIG. 16, the first section 70 is provided with first section apertures 75, which provide a flow path from the chamber 40 and the area 70. The second section 80 is provided with second section apertures 85, which provide a flow path from the chamber 30 and the area 80. Thus, the proper orientation of the flow streams during dispensing is accomplished.

Figure 3:
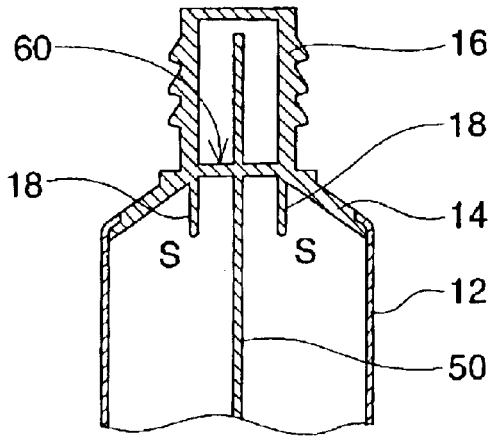
FIG. 3 shows a partial sectional view of another preferred embodiment of the tube of the present invention.

In any of the embodiments described herein, the shoulder 14 may further be comprised of an inward extension 18, such as is disclosed in WO 00/13981, "Dentifrice Tube," published to Chan et al. on Mar. 16, 2000, and as shown, e.g., in FIG. 3. Preferably, the inward extension 18, the shoulder 14, the nozzle 16, and the flow regulating element 60 are all formed from a unitary piece of material (e.g., by injection molding) as shown in the Figures; alternatively, they may be comprised of separate pieces fused or otherwise securely attached to each other by any means known to those of skill in the art. In addition, they preferably have the same material composition, but alternatively may be comprised of differing material compositions. At least one extension 18 is located in the interior of the tube 10, and extends from the shoulder 14 in the general direction of the body 12 (as opposed to extending in the general direction of the nozzle 16). This extension 18 may be provided in various configurations, as will be explained in greater detail below.

The extension 18 functions as a baffle or funnel that permits the portion of the contents contained in the central regions of the tube 10 (i.e., generally most directly under the nozzle 16) to be dispensed, while substantially preventing the contents contained in the shoulder areas S (i.e., the interior region of the tube that is generally bounded by the body portion and the shoulder portion) from being dispensed, when the tube 10 is squeezed by the user. Without the extension 18, content contained in the shoulder areas is free to mix into the dispensing flow. Thus, the extension 18 maintains a static layer of the contents in the shoulder areas.

In the context of a dentifrice product contained in a conventional dentifrice tube, the overall flavor characteristic of the product tends to be diminished as a result of the absorption and transmission of the flavor additive into the packaging materials such as the tube laminate, the shoulder, and the barrier insert. In addition, some flavor additives are comprised of several different components, and in such cases, there may be uneven rates of migration between these various components to the tube packaging materials. This causes a loss of the original flavor characteristic. In conventional tubes, the portion of the dentifrice that is most likely to have a diminished overall flavor and/or a loss of the original flavor characteristic is located in the shoulder areas. Thus, it is desirable to prevent the dentifrice contained in the shoulder areas from being dispensed.

The tube 10 of the present invention can substantially prevent the flow of the dentifrice contained in the shoulder area from dispensing out or mixing with the rest of the product. The extension 18 creates a static layer of dentifrice in the shoulder areas S (see FIG. 3) that is not dispensed as the tube 10 is squeezed. This static layer is comprised of the dentifrice that has experienced a loss and/or alteration of the original flavor characteristic due to migration and transmission of the flavor additive. Thus, by preventing that portion of the product from being dispensed, the tube 10 of the present invention provide a truer and more uniform flavor characteristic to the user throughout the entire usage cycle of the tube 10.

Many other preferred embodiments of the present invention in which the tube 10 is provided with the inward extension 18 are possible. Any of the embodiments described and shown in the above-referenced Chan et al. WO 00/13981 publication may be provided to the tube 10 of the present invention and are within this scope of the present invention.

For example, in another preferred embodiment the extension 18 is of a tapered shape to provide it with a degree of flexibility. This shape can provide those users who do wish to dispense all of the product contained in the tube (i.e., those who do not want the product contained in the shoulder area to be left in the tube upon disposal) with the option of squeezing down the shoulder portion 14 to completely dispense the product in the shoulder areas S. Preferably, the tapered shaped is formed such that the extensions 18 can readily collapse when pressure is exerted at the shoulder portion 14.

In other preferred embodiments, the extension 18 has dimensions defined by the overall tube dimensions. Without being bound by theory, and depending on size of the tube and the size of the nozzle opening, it is believed that the length of the extension 18 can desirably be a minimum of 3 mm in length, and up to a maximum length equal to the diameter of the body portion 12 of the tube. The diameter of the extension 18 can desirably be equal to or greater than the tube's orifice diameter.

In other preferred embodiments, the extension 18 is provided in the form of at least one ring 18. Multiple rings may also be provided, each ring having a corresponding radius that emanates outward from an imaginary centerline longitudinally drawn through the tube 10 from the center of the nozzle orifice, roughly corresponding to the divider 50. The rings may be concentric and uniformly spaced from each other, but the location, shape, and spacing of each ring may be varied. For example, the shape may be circular, triangular, oval, square, or any other shape, and may be symmetrical or non-symmetrical. The rings can be non-continuous or continuous, or a combination of continuous and non-continuous rings.

The extension 18 (or the multiple extensions 18) may extend into the interior of the tube in a direction that is parallel to the nozzle 16 (and also parallel to the imaginary centerline longitudinally drawn through the tube 10 from the center of the nozzle orifice). Or, the extensions 18 are not parallel to the nozzle 16. Instead, the extensions 18 may be provided at an angle formed with respect to an imaginary line drawn in the longitudinal direction of the tube 10 from the interior wall of the nozzle 16. Preferably, the angle may extend up to 60 degrees in either direction with respect to this imaginary line. Without being bound by theory, it is believed that 60 degrees is an approximate functional maximum that if exceeded, may cause difficulties in the releasing the tube from the injection molding equipment that is typically used in the manufacture of the tube.

Figure 4:
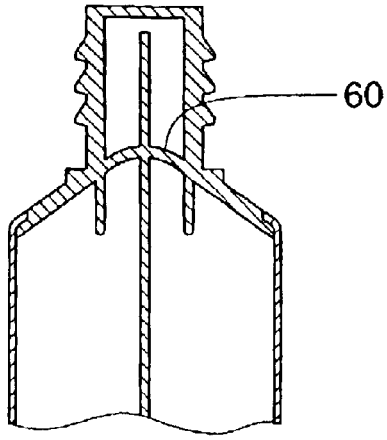
FIGS. 4–11 show partial sectional views of additional preferred embodiments of the tube of the present invention.
Figure 5:
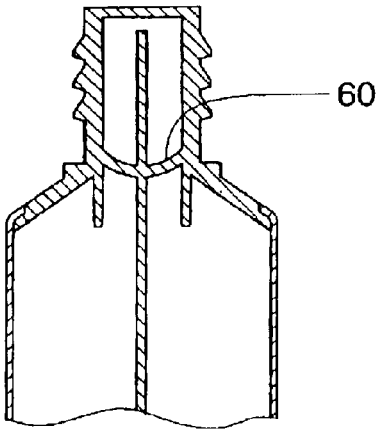
Figure 6:
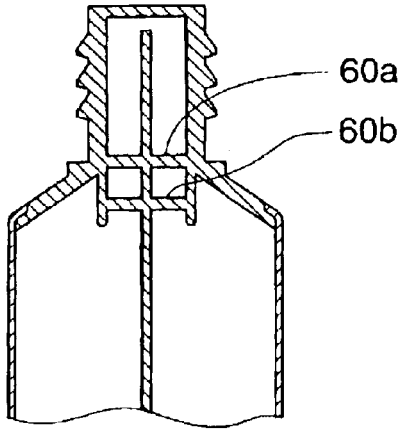
Figure 7:
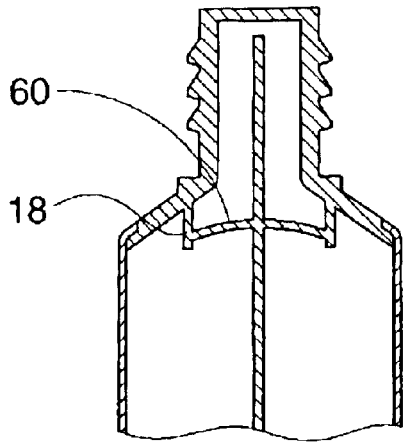
Figure 8:
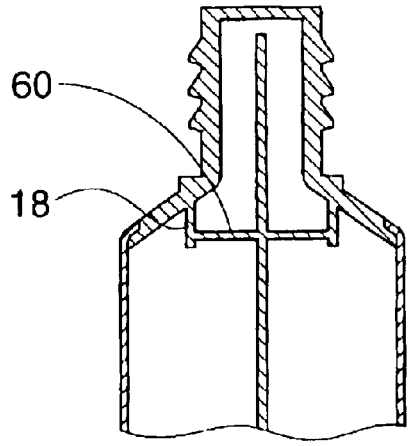
Figure 9:
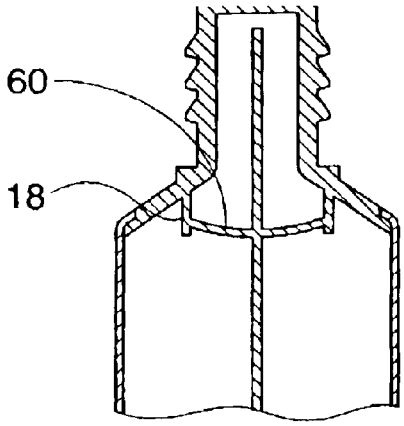
Figure 10:
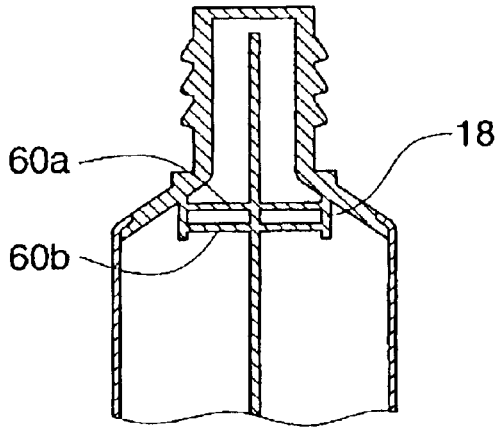

In addition to the preferred embodiment of the flow regulating element 60 shown in FIGS. 1 and 2, other preferred embodiments of this element 60 may be provided. For example, another preferred embodiment is shown in FIG. 4, in which the flow regulating element 60 is convex shaped. The preferred embodiment shown in FIG. 5 is concave shaped. As shown in FIGS. 4 and 5, these preferred embodiments of the tube 10 are provided with an extension 18; however, it should be understood that it is not necessary for the extension 18 be present. FIG. 6 shows yet another preferred embodiment in which the flow regulating element 60 is comprised of two or more tiers 60*a*, 60*b*.

Figure 11:
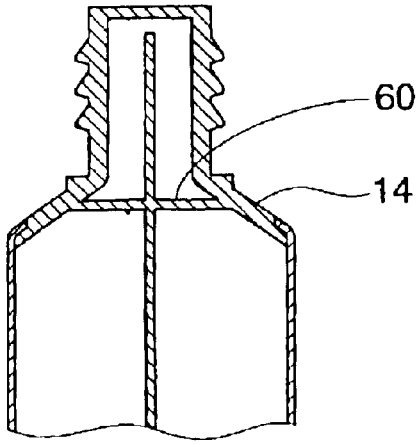
Figure 12A:
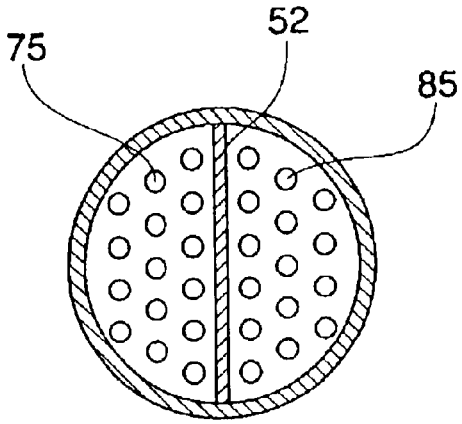
FIGS. 12*a*–12*e* show top views of additional preferred embodiments of a portion (i.e., the flow regulating element) of the tube of the present invention.
Figure 12B:
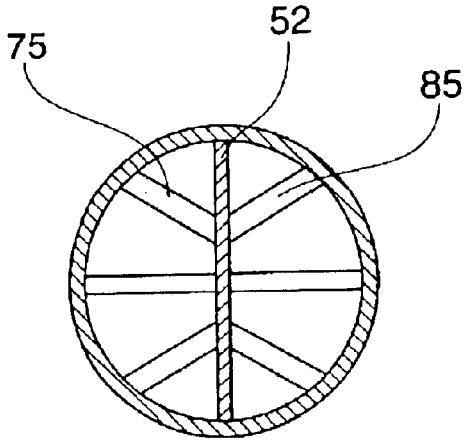
Figure 12C:
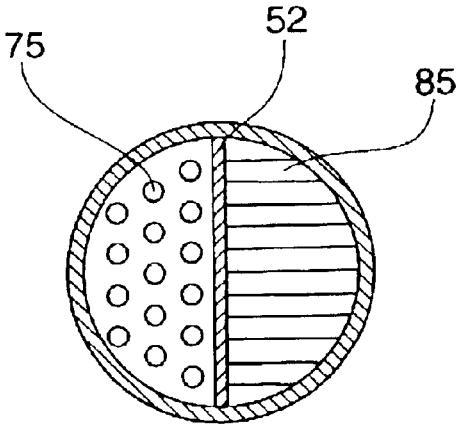
Figure 12D:
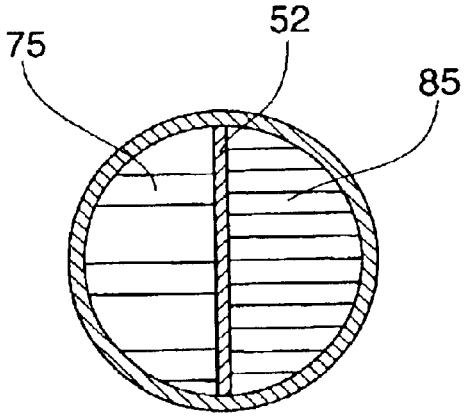
Figure 12E:
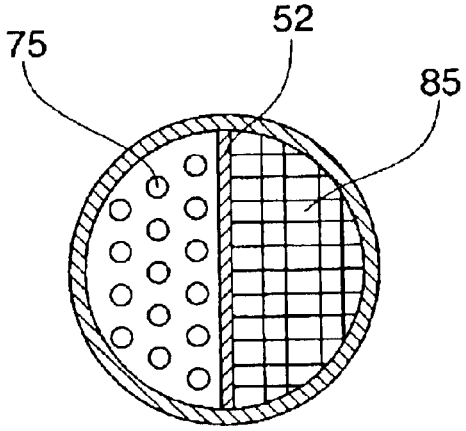

FIGS. 7–11 show additional preferred embodiments of the tube of the present invention. These embodiments are similar to those in FIGS. 1–6; however, the location of the flow regulating element 60 is different. In the preferred embodiments shown in FIGS. 7–10, the element 60 extends between the extension 18, rather than being located at the base of the nozzle. In FIG. 11, the element 60 extends between the shoulder walls 14. Any of the previously described shapes and configurations of the flow regulating element may be incorporated.

Many different configurations of the flow regulating element 60 itself, as well as first and second section apertures 75 and 85 therein, are also possible and are within the scope of the present invention. For example, FIGS. 12*a–e* show additional non-limiting preferred embodiments of the flow restricting element 60 with various configurations of the first and second section apertures. Any number, shape, and dimension of the individual apertures in each section of the flow regulating element 60 may be provided herein, as long as uniform internal pressure in all chambers is achieved, based upon the viscosity and rheology characteristics of each of the components contained in each of the chambers of the tube. The important end result is that the contents housed in each chamber of the tube are dispensed simultaneously and at a uniform dispensing rate.

It should also be noted that within a particular section of the flow regulating element 60, the size, shape and dimension of the apertures in that section may or may not be similar or identical. For example, round apertures as well as square apertures could be located in the same section of the flow regulating element.

Figure 14:
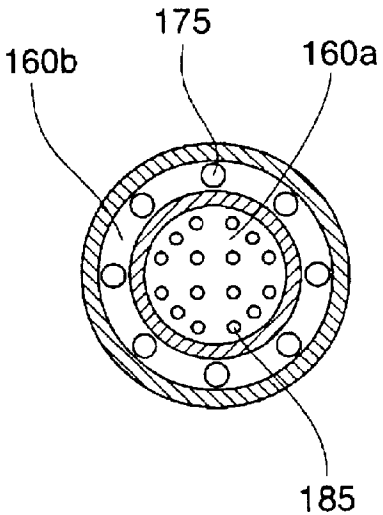
FIG. 14 shows a top sectional view taken along line 14—14 in FIG. 13.
Figure 13:
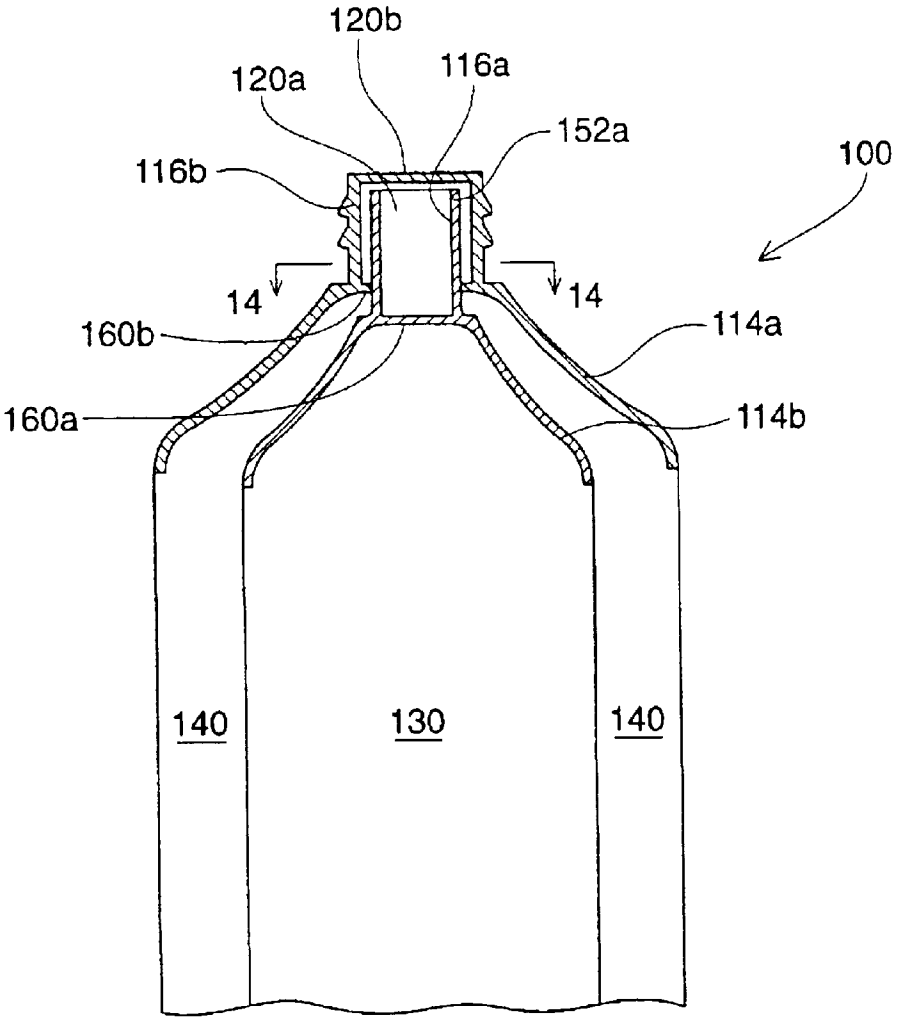
FIG. 13 shows a partial sectional view of another preferred embodiment of the tube of the present invention.

In another preferred embodiment of the present invention, for example as shown in FIGS. 13 and 14, the chambers 130 and 140 comprising the tube body are concentric, with the first chamber 130 being concentrically disposed within the second chamber 140. The body is sealed at the end opposite the dispensing orifice 120*b* by a crimp seal (not shown on FIG. 13). Each chamber is provided with a shoulder 114*a*, 114*b*, and a nozzle 116*a*, 116*b*. A first portion of the contents is housed in the first (inner) chamber 130 and a second portion of the contents is housed in the second (outer) chamber 140.

To provide uniform dispensing of the first and second components, a first flow regulating element 160*a* is provided in the shoulder region of the first chamber 130. The first flow regulating element 160 may be made according to any of the previously described preferred embodiments. However, because only the first portion of the contents will exit the tube via the first flow regulating element 160*a*, it is not necessary that the first flow regulating element 160*a* be provided with sections. The first flow regulating element 160*a* surrounds the second nozzle 116*b* and/or the second shoulder 114*b*.

A second flow regulating element 160*b* is provided in the shoulder region of the second chamber 140, surrounding the first chamber 130 or the nozzle 116*a* that is provided to the first chamber 130. As with the first flow regulating element 160*a*, the second flow regulating element 160*b* may be made according to any of the previous description of preferred embodiments. Similarly, because only the second portion of the contents will exit the tube via the first second regulating element 160*a*, it is not necessary that the second flow regulating element 160*a* be provided with sections.

The relationship of the first and second flow regulating elements 160*a* and 160*b* can also be seen in FIG. 14. In FIG. 14, the first apertures and the second apertures 175 and 185 can be seen. As in the previously described embodiments, the first apertures 175 provide a flow path for the first component housed in the first (inner) chamber 130. The second apertures 185 provide a flow path for the second component housed in the second (outer) chamber 140.

Referring again to FIG. 13, each nozzle 116*a*, 116*b* is provided with an orifice 120*a*, 120*b* through which the corresponding portion of the product exits the corresponding chamber when the tube body 12 is squeezed by the user. In the preferred embodiment shown in FIG. 13 it is further desirable that the uppermost end 152*a* of the nozzle 116*a* (corresponding to the first chamber 130) does not extend all the way to the plane of the nozzle opening orifice of the second chamber 140. Preferably there is a clearance of from about 1 to about 3 mm. This clearance allows the component streams, e.g., the first portion of the contents housed in chamber 130 and the second portion of the contents housed in chamber 140, to merge just before actually exiting the orifice. As described above, this merging is important for ensuring even dispensing appearance of a dual phased product from the tube.

Unlike the preferred embodiment shown for example in FIG. 1, the preferred embodiment shown in FIG. 13 does not incorporate a divider wall 50 for the purpose of separating the body into multiple chambers. A divider wall 50 is not necessary in such embodiments.

The embodiments represented by the previous examples have many advantages. For example, they provide there a multi-chambered dispensing tube that can consistently deliver the same amount, shape, and size of component compositions contained in each chamber simultaneously under the same dispensing rate. The preferred embodiments herein are also cost effective to manufacture.

As used herein the term "comprising" means that other steps and other ingredients that do not affect the end result can be added. This term encompasses the terms "consisting of" and "consisting essentially of."

It is understood that the examples and embodiments described herein are for illustrative purposes only and that various modifications or changes in light thereof will be suggested to one skilled in the art without departing from the scope of the present invention.

What is claimed is:

1. A multi-chambered tube for containing and dispensing a contents, comprising:

(a) a body divided by at least one divider wall into at least two chambers, each chamber housing a portion of the contents, the body being sealed at one end by a crimp seal and one end of the divider wall being sealed within the crimp seal;

(b) a shoulder attached to the body;

(c) a nozzle attached to the shoulder and provided with an orifice through which the contents are dispensed;

(d) a flow regulating element located in the shoulder of the tube and being comprised of as many sections as there are body chambers, and each section being provided with at least one aperture, wherein a dimension or number of the apertures is determined by the viscosity and rheology of the portions of the contents, and wherein a smaller dimension or number of the apertures is chosen when the portion of the contents has a lower viscosity and a larger dimension or number of the apertures Is chosen when the portion of the contents has a higher viscosity;

(e) at least one partition separating the sections of the flow regulating element from each other and dividing the nozzle into as many nozzle chambers as there are body chambers, each nozzle chamber being in communication with a body chamber via the at least one aperture in the corresponding section of the flow regulating element; and (f) wherein the shoulder is provided with an extension extending into the body wherein the contents housed in the shoulder area or the tube are substantially prevented from being dispensed when the tube squeezed.

2. A dual chambered tube for containing and dispensing a contents, comprising:

(a) a body divided by a divider wall into a first chamber housing a first portion of the contents and a second chamber housing a second portion of the contents, the body being sealed at one end by a crimp seal and one end of the divider wall being sealed within the crimp seal;

(b) a shoulder attached to the body;

(c) a nozzle attached to the shoulder and provided with an orifice through which the contents are dispensed;

(d) a flow regulating element located in the shoulder of the cube and being comprised of a first section provided with at least one tint section aperture and a second section provided with at least one second section aperture wherein a dimension or number of the apertures is determined by the viscosity and rheology of the portions of the contents, and wherein a smaller dimension or number of the apertures is chosen when the portion of the contents has a lower viscosity and a larger dimension or number of the apertures is chosen when the portion of the contents has a higher viscosity;

(e) a partition separating the first section of the flow regulating element from the second section of the flow regulating clement and dividing the nozzle into a first nozzle chamber in communication with the first body chamber via the first section at least one aperture and a second nozzle chamber in communication with the second body chamber via the second section at least one aperture; and (f) wherein the shoulder is provided with an extension extending into the body wherein the contents housed in the shoulder area of the tube are substantially prevented from being dispensed when the tube is squeezed.

3. A multi-chambered tube for containing and dispensing a contents. comprising (a) a body comprising at least a first chamber housing a first portion of the contents and a second chamber housing a second portion of the contents, the first chamber being concentrically disposed within the second chamber and the body being sealed at one end by a crimp seal;

(b) a first shoulder attached to the first chamber;

(c) a first nozzle attached to the first shoulder and provided with a first orifice;

(d) a second shoulder attached to the second chamber;

(e) a second nozzle attached to the second shoulder and provided with a second orifice through which the contents are dispensed; the first orifice being terminated at a location below the second orifice, (f) a first flow regulating element in the first shoulder of the first chamber, the first flow regulating element having at least one aperture located therein such that the first portion of the contents passes through the first flow regulating element during dispensing, wherein a dimension or number or the apertures is determined by the viscosity and rheology of the portions of the contents, and wherein a smaller dimension or number of the apertures is chosen when the portion of the contents has a lower viscosity and a larger dimension or number of the apertures is chosen when the portion of the contents has a higher viscosity;

(g) a second flow regulating element located in the shoulder of the second chamber, the second flow regulating element having at least one aperture located therein such that the second portion of the contents passes through the second flow regulating element during dispensing, wherein the number and dimension of the apertures is determined by the viscosity and rheology of the portions of the contents, and wherein a smaller dimension or number of the apertures is chosen when the portion of the contents has a lower viscosity and a larger dimension or number of the apertures is chosen when the portion of the contents has a higher viscosity; and (h) wherein the shoulder is provided with an extension extending into the body wherein the contents housed in the shoulder area of the tube are substantially prevented from being dispensed when the tube is squeezed.

* * * * *